US005088559A

United States Patent [19]

Taliaferro

[11] Patent Number: 5,088,559

[45] Date of Patent: Feb. 18, 1992

[54] METHOD AND APPARATUS FOR RUNNING WIRELINE AND REELED TUBING INTO A WELLBORE AND STUFFING BOX USED IN CONNECTION THEREWITH

[76] Inventor: William D. Taliaferro, 408 Shockley, Desoto, Tex. 75115

[21] Appl. No.: 620,876

[22] Filed: Nov. 28, 1990

[51] Int. Cl.[5] ..... E21B 19/08; E21B 33/02

[52] U.S. Cl. ..... 166/379; 166/77; 166/84; 166/85; 166/102; 166/384; 166/385; 166/387; 277/32; 277/73; 277/103

[58] Field of Search ..... 166/377-380, 166/384, 385, 387, 75.1, 77, 80, 84, 85, 102; 277/32, 73, 103, 127

[56] References Cited

U.S. PATENT DOCUMENTS 3,626,505 12/1971 Douglas ..... 277/73
3,762,725 10/1973 Taylor ..... 277/32
3,827,487 8/1974 Jackson et al. ..... 166/77
4,310,139 1/1982 Williams, III et al. ..... 277/103
4,386,783 6/1983 Davis ..... 277/103
4,575,044 3/1986 Gentry ..... 251/145
4,655,291 4/1987 Cox ..... 166/385
4,836,289 6/1989 Young ..... 166/379
4,940,095 7/1990 Newman ..... 166/378

*Primary Examiner*—Hoang C. Dang
*Attorney, Agent, or Firm*—Warren B. Kice

[57] ABSTRACT

A method and apparatus for running wireline and reeled tubing into a wellbore in which an adapter tube extends through the reeled tubing injector to enable the wireline rig to be mounted on the reeled tubing rig. A stuffing box is also provided which can easily be converted to accommodate wireline or to accommodate reeled tubing.

16 Claims, 2 Drawing Sheets

METHOD AND APPARATUS FOR RUNNING WIRELINE AND REELED TUBING INTO A WELLBORE AND STUFFING BOX USED IN CONNECTION THEREWITH

BACKGROUND OF THE INVENTION

This invention relates to a method and apparatus for running wireline and reeled tubing into and from a wellbore, and a stuffing box for use in connection therewith.

Downhole well operating tools are often used in completed wells for performing several functions. Typically these tools are lowered by a wireline into a downhole location and, after the work is performed, they are retrieved, or pulled, from the wellbore by a pulling tool or the like, also connected to the wireline.

Highly deviated and horizontal well completions have created the need for coiled, or reeled, tubing that does not rely on gravity for setting and retrieval of downhole tools. Reeled tubing has also proven to be advantageous from a time and money saving potential in connection with other operations such as sand washing with liquid or foam, fluid displacement, injection of parafin or corrosion inhibitors, spotting acid, light duty drilling of cement and the like, fishing operations, and flow line cleanout.

Since both wireline operations and reeled tubing operations have their separate and distinct advantages, it often becomes necessary to utilize both to service certain wells. For example, it is often desirable to utilize reeled tubing for performing a washing function, after which wireline is used for inserting and removing tools into and from the wellbore. In this example, a reeled tubing rig would initially be assembled over the wellbore, and would include a reeled tubing injector extending over a stuffing box which, in turn, is connected to a blow out preventor, or the like. A goose neck is usually connected to the upper portion of the injector for guiding the reeled tubing into the injector which injects the reeled tubing through the stuffing box and the blow-out preventor into the wellbore. After the operation utilizing the reeled tubing is completed, this rig has to be disassembled, and the components necessary to guide the wireline into the wellbore are assembled over the wellbore. These latter components normally include wireline blow-out preventor, one or more lubricator sections and a pulley, or the like for the wireline. It is apparent that the disassembly of the reeled tubing rig and the assembly of the wireline rig are very tedious, difficult, time consuming and costly.

SUMMARY OF THE INVENTION

It is therefore an object of the present invention to provide an apparatus and method for inserting and removing both wireline and reeled tubing from a wellbore utilizing common components.

It is a further object of the present invention to provide an apparatus and method of the above type which reduces labor and costs associated with disassembling and reassembling the rigs normally associated with reeled tubing operations and wireline operations.

It is a further object of the present invention to provide an apparatus and method of the above type in which the injector normally utilized in connection with the reeled tubing operation can be maintained in place during the wireline operation.

It is a further object of the present invention to provide an apparatus and method of the above type in which the components for inserting and withdrawing the wireline can be mounted on the components for inserting and withdrawing the reeled tubing with a minimum of labor.

It is a still further object of the present invention to provide an improved wireline insertion and removal assembly which utilizes an elongated injector tube connecting a stuffing box to the wireline guiding apparatus.

It is a still further object of the present invention to provide a stuffing box which can be utilized for both reeled tubing insertion and injection operations as well a for wireline insertion and injection operations.

It is a still further object of the present invention to provide a stuffing box which has interchangeable components for respectively accommodating reeled tubing an wireline.

Toward the fulfillment of these and other objects the present invention includes an adapter tube which enables the wireline rig to be mounted on the reeled tubing rig. A stuffing box is also provided which can easily be converted to accommodate reeled tubing or to accommodate wireline.

BRIEF DESCRIPTION OF THE DRAWINGS

The above description, as well as further objects, features and advantages of the present invention will be more fully appreciated by reference to the following detailed description of the presently preferred but nonetheless illustrated embodiments in accordance with the present invention when taken in conjunction with the accompanied drawings wherein.

DESCRIPTION OF THE PRIOR ART

Figure 1:
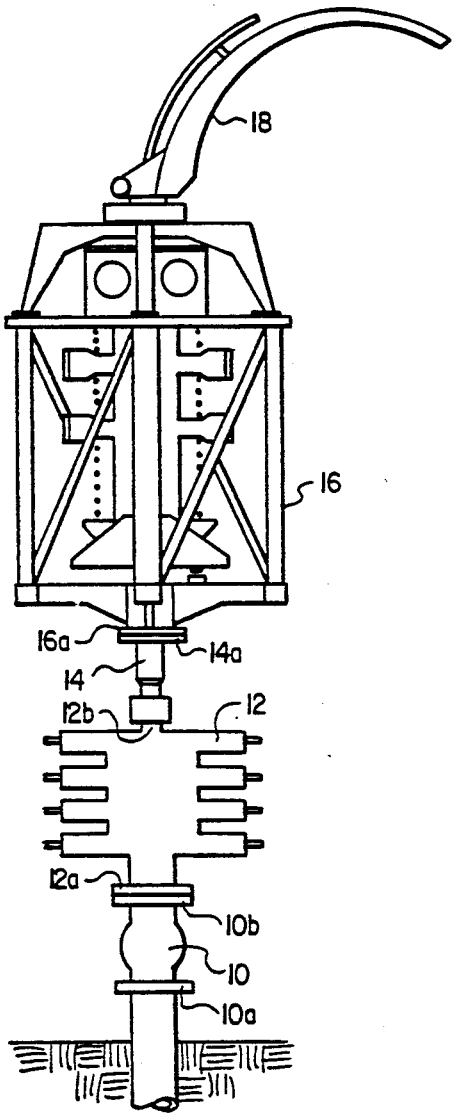
FIG. 1 (PRIOR ART)
FIG. 1 is a front elevational view depicting a prior art assembly for inserting and removing reeled tubing from a wellbore.

FIG. 1 refers to a prior art system for injecting reeled tubing into a wellbore. A wellhead 10 extends slightly above ground and a circular, radially-extending flange **10*a* is formed at the base of the wellhead for connection to a string of components extending into the wellbore. A circular flange 10*b* is provided at the upper end of the wellhead 10 and is bolted to a complimentary flange 12*a* on the lower end of a blowout preventer 12. The wellhead 10 and the blow out preventor 12 both contain internal valving which can be closed to prevent any high pressure well fluid from passing upwardly therethrough. A small pipe, or cylinder, 12*b* is provided at the upper end of the blowout preventer 12 and extends into the lower end portion of a stuffing box 14. As will be described in greater detail later, the upper portion (not shown) of the stuffing box 14 extends into an injector 16 and a circular flange 14*a* extends radially outwardly from the stuffing box 14 and is bolted to a complimentary flange 16*a* at the base of the injector 16. The injector 16 is adapted to operate in a conventional manner to drive reeled tubing (not shown) down into the wellbore. To this end, a goose neck assembly 18 is attached to the upper end of the injector 16 for receiving and guiding the reeled tubing. An example of an injector 16** is disclosed in U.S. Pat. No. 4,655,291, assigned to the assignee of the present invention.

Figure 2:
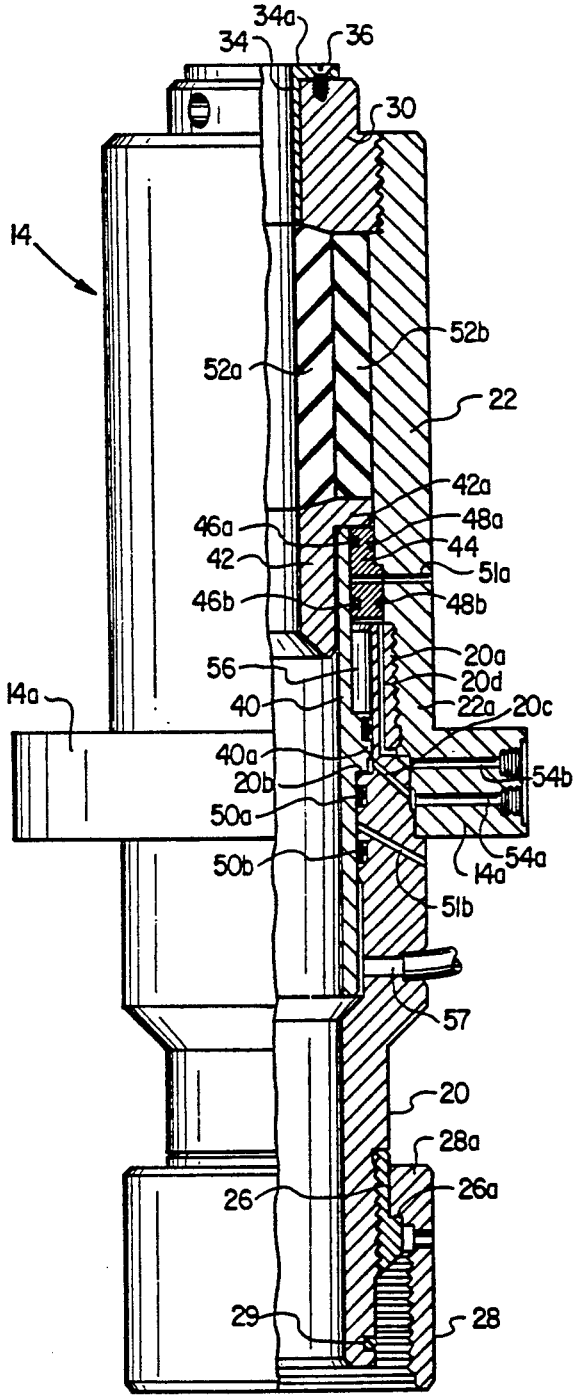
FIG. 2 (PRIOR ART)
FIG. 2 is an enlarged, vertical, cross-sectional view of the prior art stuffing box depicted in FIG. 1.

Referring to FIG. 2, which depicts the stuffing box 14 in greater detail, the reference numeral 20 refers to a lower tubular body member having stepped inner and outer diameters. The outer diameter of the upper section 20*a* of the body member 20 as viewed in FIG. 2, is reduced and telescopically receives a corresponding lower section 22*a* of an upper tubular body member 22 having a stepped inner diameter. A plurality of threads are provided on the outer surface of the section 20*a* and the corresponding inner surface of the section 22*a*, which engage to connect the two members 20 and 22.

A portion of the outer diameter of the lower end portion of the body member 20 is threaded and receives an internally threaded sleeve 26 having an enlarged-diameter end portion defining a shoulder 26*a* which receives an inwardly directed flange 28*a* of a union nut 28. The inner surface of the lower end portion of the union nut 28 is threaded for receiving the pipe 12*b* (FIG. 1) of the blowout preventer 12. An O-ring 29 is provided in a groove formed in the outer surface of the lower end portion of the body member 20 for engaging the sleeve 12*a* to seal against the flow of fluids.

A retainer ring 30 extends in the upper end portion of the upper body member 22, with the outer surface of the ring 30 and the corresponding inner surface of the upper end portion of the upper body member 22 being in threaded engagement. A split bushing 34 extends within the ring 30 and in engagement with the inner wall thereof, and a set screw 36 extends through a radially outwardly-directed flange 34*a* on the bushing 34 to fasten it to the ring 30.

A piston sleeve 40 extends within the assembled body members 20 and 22 and is adapted for reciprocal slidable movement relative thereto in an axial direction. An intermediate portion of the outer wall of the sleeve 40 is enlarged to form a flange 40*a* which engages an upper inner shoulder 20*b* of the body member 20 in the lower portion of the sleeve 40 as shown. The upper end portion of the sleeve 40 extends within a packing ring 42 disposed in the bore of the upper body member 22 and the upper end of the sleeve 40 engages a radially outwardly directed flange 42*a* of the ring 42.

A cylinder ring 44 extends between the upper end portion of the sleeve 40 and the upper body member 22. A pair of seal rings 46*a* and 46*b* extend in spaced grooves formed in the inner surface of the ring 44, and a pair of O-rings 48*a* and 48*b* extend in grooves formed in the outer surface of the ring 44. The seal rings 46*a* and 46*b* engage the outer surface of the sleeve 40, and the O-rings 48*a* and 48*b* engage the inner surface of the upper body member 22.

An additional pair of O-rings 50*a* and 50*b* are formed in axially-spaced grooves formed in the inner surface of the lower body member 20 in engagement with the outer surface of the sleeve 40. A weep passage 51*a* is formed by a radial bore extending through the ring 44 and registering with a radial bore formed through the body member 22, and a weep passage 51*b* is formed by an angled bore formed through the body member 20. The weep passages 51*a* and 51*b* are for the purpose of monitoring leakage through the seal rings 44 and 50*a*, 50*b* respectively.

A pair of packing sleeves 52*a* and 52*b*, fabricated of a resilient material, such as rubber, extend between the flange 42*a* of the packing ring 42 and the lower end of the ring 30. The sleeve 52*b* is disposed adjacent the inner wall of the upper body member 22 and is telescoped over the sleeve 52*a*.

The circular flange 14*a* is formed at the lower end of the upper body member 22, and a first radial passage 54*a* is formed through the flange 14*a* and extends to an angular bore 20*c* formed through the wall of the lower body member 20. Similarly, a second radial passage 54*b* is formed through the flange 14*a* and extends to a vertical bore 20*d* formed in the lower body member section 20*a*. The upper end of the bore 20*d* registers with a chamber 56 defined by the cylinder ring 44, the lower body section 20*a*, the sleeve 40, and the flange 40*a*.

A radial passage 57 extends through the lower body member 20 for connection to a hose pipe, or the like, which extends to pressure monitoring equipment, (not shown) for monitoring the internal fluid pressure in the stuffing box 14.

The bushing 34, the packing sleeve 52*a* and the packing ring 42 define a reduced-diameter axial bore in the stuffing box 14 which receives the reeled tubing (not shown). The diameter of this reduced-diameter bore is only slightly greater than the outer diameter of the reeled tubing so that the packing sleeve 52*a* can be activated to provide a seal against the flow of fluid from the well upwardly between the inner surface of the sleeve 52*c* and the outer surface of the reeled tubing. To this end, after the reeled tubing is passed through the stuffing box 14, fluid from an external source is introduced into the passage 54*a* and flows through the bore 20*c* and against the flange 40*a* of the piston sleeve 40 to drive it upwardly and thus compress the sleeves 52*a* and 52*b*. This causes the sleeve 52*a* to expand radially outwardly into engagement with the reeled tubing. To release this engagement, fluid is introduced into the passage 54*b* which drives the sleeve 40 downwardly to the position of FIG. 2.

DESCRIPTION OF THE PREFERRED EMBODIMENT

Figure 3:
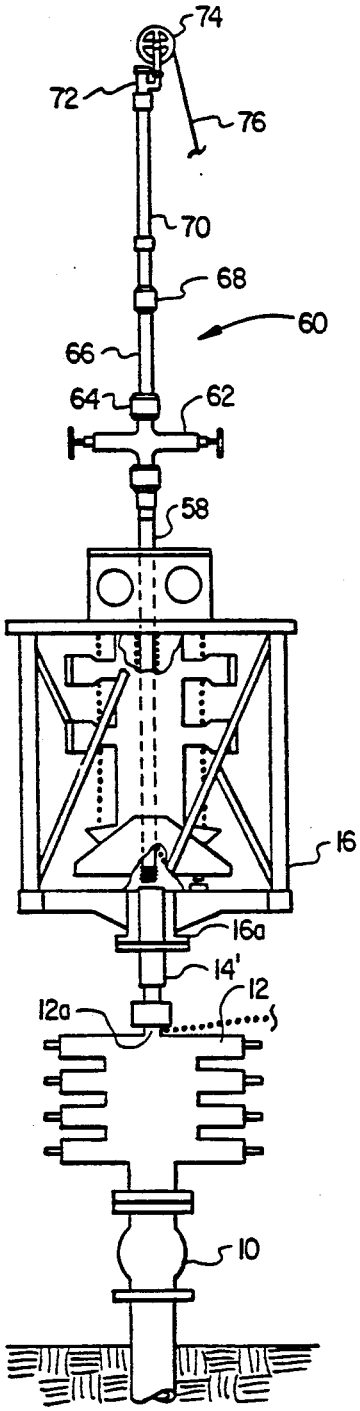
FIG. 3 is a view similar to FIG. 1 but depicting the apparatus of the present invention adapted to accommodate both wireline and reeled tubing.

The apparatus of the present invention is shown in FIG. 3 and includes several components shown in, and described in connection with, FIG. 1, which components are given the same reference numerals. As in the prior art arrangement of FIG. 1, the embodiment of FIG. 3 includes the blow-out preventor 12 connected between the wellhead 10 and a stuffing box 14' which is connected to the injector 16 and which is similar to the stuffing box 14 but is modified in accordance with the present invention as will be described in detail. The respective connections between these components are the same as described in connection with FIG. 1.

According to the arrangement of FIG. 3, the goose neck assembly 16 is removed from the upper portion of the injector 16 and an injector tube 58 is inserted through the injector 16 which is maintained in its "open" position to accommodate the tube. The lower end of the tube 58 extends within the upper portion of the modified stuffing box 14' within the housing of the injector assembly 16.

The upper end portion of the tube 58 projects upwardly from the housing of the injector 16 and is connected to the lower end of a lubricator assembly, shown in general by the reference numeral 60. The assembly 60 includes a wireline valve, or blow-out preventor, 62 the upper end of which is connected, via a union nut 64, to a lower lubricator section 66 which, in turn, is connected, via a union nut 68, to an upper lubricator section 70. The upper end of the lubricator section 70 is connected to a stuffing box 72 having a pulley 74 connected to its upper end for receiving the leading end portion of a supply of wireline 76. The lubricator assembly 60 is for the purpose of receiving and guiding the wireline 76 while sealing against the upward flow of well fluid, and an example of this type of assembly is disclosed in U.S. Pat. No. 4,575,044, assigned to the assignee of the present invention. As disclosed in this patent, the lubricator assembly 60 is normally designed to be directly connected to the wellhead 10, or to a component in the string of components extending into the wellbore.

In operation, and assuming the reeled tubing rig of FIG. 1 is in place above the wellhead 10 as shown, and a reeled tubing operation has been completed, the wellhead 10 and/or the blow out preventor 12 are closed to seal against the flow of high pressure well fluid upwardly therethrough. The reeled tubing is then pulled from the wellbore and clamped to the goose neck assembly 18 and the goose neck assembly 18, along with the reeled tubing, are removed from the injector 16. The injector 16 is maintained in its "open" position for receiving the reeled tubing and the stuffing box 14 is modified to the stuffing box 14' as will be described in connection with FIG. 4.

The injector tube 58 is then inserted into and through the injector 16 until its lower end portion extends into the upper end of the modified stuffing box 14', and its upper end portion projects from the upper portion of the injector 16 as shown in FIG. 3. The lubricator assembly 60 is mounted above the injector 16 by connecting the lower portion of the wireline blow out preventor 62 to the upper end of the injector tube 58. Thus, the wireline 76 can be played out from a reel (not shown) and over the pulley 74, through the wireline stuffing box 72, the lubricator sections 66 and 70, the wireline blow out preventor 62, the injector tube 58, and the modified stuffing box 14'.

The reeled tubing blow-out preventor 12 and the wellhead 10 ar then opened since the wireline blow out preventor 62 and the wireline stuffing box 66 function to seal against the flow of any high pressure well fluid upwardly therethrough. Then the wireline 76 can be advanced through the blow-out preventor 12, the wellhead 10, and inserted into the wellbore. An operating tool, or tool string, of any conventional design can be connected to the leading end of the wireline 76 and wireline operations can be performed in the wellbore without the tedious, laborious and expensive requirement of removing the injector 16 and the reeled tubing blow-out preventor 12, and installing the lubricator assembly 60 directly to the wellhead 10.

Figure 4:
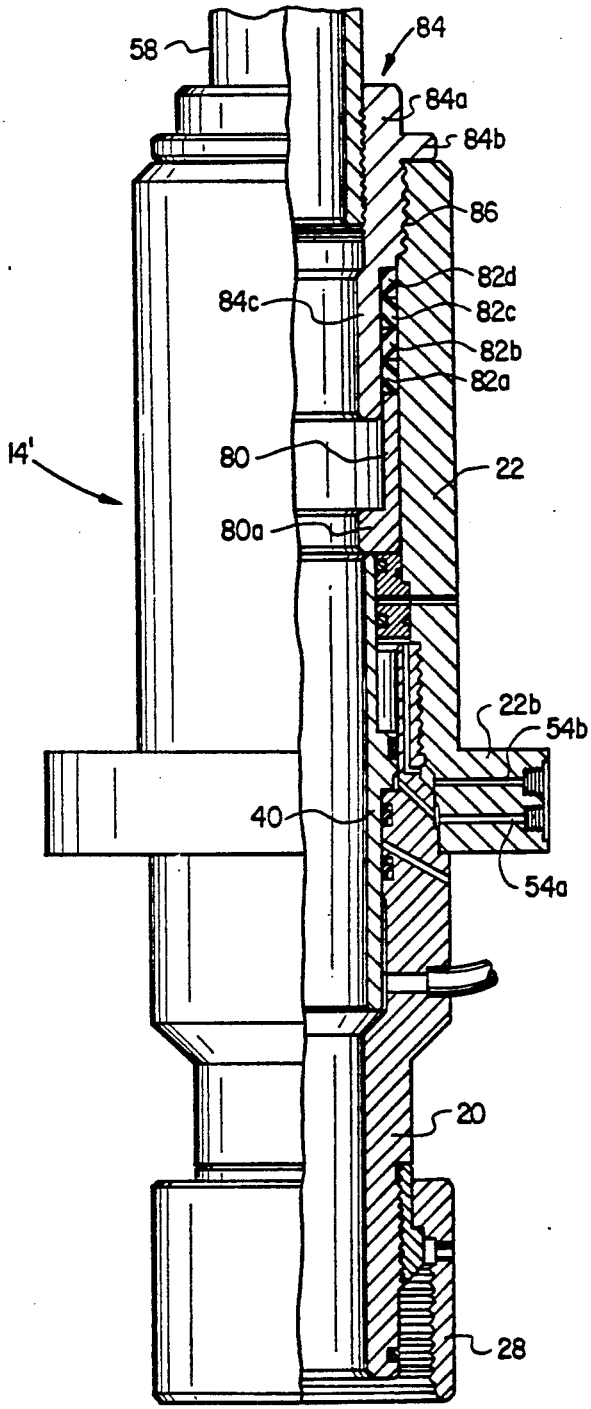
FIG. 4 is a view similar to FIG. 2 but depicting the stuffing box of the present invention.

FIG. 4 depicts the modified stuffing box of the present invention, which is referred to in general by the reference number 14' and which contains several components of the stuffing box 14 of FIG. 2 which are referred to by the same reference numerals. The stuffing box 14 is converted to the stuffing box 14' by removing the retainer ring 30 (FIG. 2), the split bushing 34, the set screw 36, the packing ring 42 and the packing sleeves 52*a* and 52*b* from the upper portion of the upper body member 22 of the stuffing box 14.

A new packing ring 80 (FIG. 4) is then placed over the upper ends of the sleeve 40 and the ring 44. The ring 80 has a stepped inner bore 80*a* which defines an enlarged lower end portion that rests against the upper ends of the sleeve 40 and the ring 44. Four packing elements 82*a*, 82*b*, 82*c* and 82*d*, each having an inner diameter and outer diameter corresponding to that of the ring 80, are placed over the upper end of the latter ring. An adapter 84 is then inserted in the upper end portion of the upper body member 22. The adapter 84 comprises a stepped main body portion 84*a* and a circular flange 84*b* projecting outwardly therefrom. The outer surface of the main body portion 84*a* is threaded and in engagement with the corresponding threaded surface on the upper end portion of the upper body member 22, and the flange 84*b* engages the upper end of the upper body member 22. The adapter 84 also includes a reduced diameter bore portion 84*c*, the outer diameter of which is slightly less than the inner diameter of the packing elements 82*a*–82*d* to enclose the elements as shown. The inner diameter of the main body portion 84*a* is threaded and receives a corresponding threaded portion of the lower end portion of the injector tube 58.

The modified stuffing box 14' is thus adopted to receive the wireline 76 and can be activated to seal against any leakage of well fluid between the adapter 84 and the upper body member 22. More particularly, when the wireline is inserted through the modified stuffing box 14, and fluid is introduced into the passage 54*a* as described in connection with the embodiment of FIG. 2, the piston sleeve 40, and therefore the packing ring 80, move upwardly to squeeze the packing elements 82*a*–82*d* between the outer surface of the adapter 84 and the inner wall of the upper body member 22. This prevents any leakage of well fluid between the adaptor member 84 and the inner wall of the upper body member 22. Of course, pressurized well fluid will initially flow upwardly through the center bore of the modified stuffing box 14' which accommodates the wireline 76, but this flow is sealed by the wireline blow-out preventor 62 and the wireline stuffing box 72.

If it is necessary to resume reeled tubing operations the procedure described above can be reversed, i.e., the lubricator assembly 60 can be removed from above the injector 16, the stuffing box 14' converted to the stuffing box 14, and the goose neck assembly 18 mounted on the top of the injector 16.

The apparatus and method of the present invention have several advantages. For example, both wireline and reeled tubing can be inserted into, and removed from, a wellbore utilizing common components. Also, labor costs associated with disassembling and reassembling the individual rigs normally associated with reeled tubing operations and wireline operations are considerably reduced. Further, the injector normally utilized in connection with the reeled tubing operation can be maintained in place during the wireline operation and the components for inserting and withdrawing the wireline can be mounted on the components for inserting and withdrawing the reeled tubing with a minimum of additional labor. Also, the wireline servicing apparatus can be easily connected to the stuffing box utilizing an adaptor tube extending through a reeled tubing injector. Further, the stuffing box of the present invention can be utilized for both reeled tubing and wireline insertion and injection operations, and the stuffing box has interchangeable components for respectively accommodating reeled tubing and wireline.

It is understood that variations ca be made in the foregoing without departing from the scope of the invention. For example, the packing elements 80*a*–80*d* can be bonded together and to the packing ring 80 for ease of assembly.

A latitude of modification, change and substitution is intended in the foregoing disclosure and in some instances some features of the invention will be employed without a corresponding use of other features. Accordingly, it is appropriate that the appended claims be construed broadly and in a manner consistent with the scope of the invention.

WHAT IS CLAIMED IS:

1. Apparatus for running wireline into a wellbore having a reeled tubing injector mounted thereover, said apparatus comprising an adapter tube extending through said injector, first means extending above said injector and connected to the upper end of said adapter tube for receiving said wireline, and second means extending below said injector and connected to the lower end of said tube for receiving said wireline from said adapter tube, wherein said wireline passes through said first means, said adapter tube and said second means before entering said wellbore.

2. The apparatus of claim 1 wherein said adapter tube extends through the area of said injector which normally is occupied by said reeled tubing in the open position of said injector.

3. The apparatus of claim 1 wherein said first means comprises a lubricator assembly connected to said adapter tube.

4. The apparatus of claim 3 wherein said lubricator assembly comprises a lubricator valve connected to the upper end of said adapter tube, and at least one lubricator section connected to the upper portion of said valve for receiving said wireline.

5. The apparatus of claim 1 wherein said second means comprises a stuffing box connected to said adapter tube and a wellhead extending between said stuffing box and said wellbore.

6. The apparatus of claim 5 further comprising a blowout preventor extending between said stuffing box and said wellbore.

7. The apparatus of claim 5 wherein said stuffing box normally receives reeled tubing and further comprising means for converting said stuffing box to receive said wireline.

8. The apparatus of claim 5 wherein said stuffing box comprises a housing, an adapter sleeve extending in said housing and defining a bore for passage of said wireline, packing means extending between said adapter sleeve and said housing, and means for compressing said packing means to seal against the passage of well fluid between said adapter sleeve and said housing.

9. A method for converting apparatus that includes an injector and a stuffing box which are normally adapted for inserting and withdrawing reel tubing from a wellbore to an apparatus for inserting and withdrawing wireline from said wellbore, said method comprising the steps of inserting an adapter tube through said injector, connecting the lower end of said adapter tube to said stuffing box, connecting the upper end of said adapter tube to a lubricating assembly for said wireline, and converting said stuffing box to accommodate said wireline.

10. The method of claim 9 further comprising the step of removing a gooseneck assembly from the upper portion of said injector prior to said step of inserting said adapter tube.

11. The method of claim 9 further comprising the step of placing said injector in its open position before said step of inserting.

12. The method of claim 9 wherein said apparatus includes a wellhead and/or blowout preventor and further comprising the steps of closing said wellhead and/or blowout preventer to prevent the flow of well fluid therethrough, and removing said reeled tubing from wellbore and said injector, before said step of inserting.

13. A stuffing box comprising tubular housing means, an adapter sleeve having a stepped main body portion and a reduced diameter portion, said reduced diameter portion extending downwardly from said main body portion into the bore of said housing means to define an annular sealing chamber, seal means disposed in said chamber and engaging for its entire length the outer surface of said reduced diameter portion and the inner surface of said housing means, and means for compressing said seal means to seal against the passage of fluid between said adapter sleeve and said housing means.

14. The stuffing box of claim 13 wherein said means for compressing said seal means comprises piston means movable axially in said bore of said housing means, and means for introducing fluid against said piston means to drive said piston means against said seal means.

15. The stuffing box of claim 13 further comprising means for introducing fluid to the other end of said piston means for driving said piston means away from said seal means to release the compression of said seal means.

16. A stuffing box for use with reeled tubing and including a tubular housing defining a central bore for receiving said reeled tubing, packing means disposed in said bore, and means for exerting a force against said packing means for compressing said packing means into engagement with said reeled tubing to seal against the flow of fluid between said reeled tubing and said housing; wherein the improvement comprises means for converting said stuffing box for use with wireline, said converting means comprising:

(1) an adapter sleeve for insertion in said bore in place of said packing means, said adapter sleeve defining, with the wall of said tubular housing, an annular space; and (2) seal means disposed in said annular space;

(3) said adapter sleeve and said seal means being constructed and arranged so that said force exerting means exerts a force against said seal means to compress said seal means into engagement with said adapter sleeve and said housing wall to seal against the flow of fluid between said adapter sleeve and said housing wall.

* * * * *

UNITED STATES PATENT AND TRADEMARK OFFICE

CERTIFICATE OF CORRECTION

PATENT NO. : 5,088,559

DATED : February 18, 1992

INVENTOR(S) : William D. Taliaferro

It is certified that error appears in the above-identified patent and that said Letters Patent is hereby corrected as shown below:

Column 1, line 48, before "wireline" insert --a--.
Column 2, line 14, change "a" to --as--.
Column 2, line 18, change "an" to --and--.
Column 4, line 54, change "16" to --18--.
Column 6, line 64, change "ca" to --can--.

Signed and Sealed this

Thirteenth Day of July, 1993

*Attest:*

Michael K. Kirk

MICHAEL K. KIRK

*Attesting Officer*

*Acting Commissioner of Patents and Trademarks*

UNITED STATES PATENT AND TRADEMARK OFFICE

CERTIFICATE OF CORRECTION

PATENT NO. : 5,088,559

DATED : February 18, 1992

INVENTOR(S) : William D. Taliaferro

It is certified that error appears in the above-indentified patent and that said Letters Patent is hereby corrected as shown below:

On the title page, Assignee Insert--Otis Engineering Corporation--

Signed and Sealed this

Tenth Day of May, 1994

Bruce Lehman

*Attest:*

BRUCE LEHMAN

*Attesting Officer*

*Commissioner of Patents and Trademarks*